US005672090A

United States Patent [19]

Liu

[11] Patent Number: 5,672,090

[45] Date of Patent: Sep. 30, 1997

[54] EQUINE-SHAPED TOY FIGURE

[75] Inventor: Dexter Chih-Teh Liu, Portsmouth, R.I.

[73] Assignee: LCD International L.L.C., Newport, R.I.

[21] Appl. No.: 561,633

[22] Filed: Nov. 22, 1995

[51] Int. Cl.[6] ..... A63H 3/00

[52] U.S. Cl. ..... 446/268; 446/485

[58] Field of Search ..... 446/268, 390, 446/484, 485, 491; 472/95, 98

[56] References Cited

U.S. PATENT DOCUMENTS

| | | | |
|---|---|---|---|
| 2,484,159 | 10/1949 | Flynn, Jr. | 240/6.4 |
| 3,808,418 | 4/1974 | Conard et al. | 240/10 G |
| 4,464,861 | 8/1984 | Fogarty et al. | 446/370 |
| 4,585,424 | 4/1986 | DeMars | 446/295 |
| 4,734,074 | 3/1988 | Kinberg et al. | 446/184 |
| 4,752,273 | 6/1988 | Woods | 446/392 |
| 4,934,980 | 6/1990 | Egolf et al. | 446/297 |
| 5,052,969 | 10/1991 | Smith | 446/268 |
| 5,114,376 | 5/1992 | Copley et al. | 446/369 |
| 5,317,489 | 5/1994 | Delli Gatti et al. | 362/157 |
| 5,328,401 | 7/1994 | DeMars | 446/295 |
| 5,356,329 | 10/1994 | Thornell | 446/485 |

*Primary Examiner*—Sam Rimell
*Assistant Examiner*—Jeffrey D. Carlson
*Attorney, Agent, or Firm*—Panitch Schwarze Jacobs & Nadel, P.C.

[57] ABSTRACT

A toy includes an equine-shaped hollow figure with hooves that are transparent or translucent. A light-emitting source is mounted inside each of the figure's legs so as to internally illuminate the hoof when the light-emitting source is illuminated. A battery power source is located within the hollow figure with a wiring circuit within the figure that electrically connects the battery power source and the light-emitting source. A motion switch is interposed in the wiring circuit between the battery power source and the light-emitting source and oriented to effect opening and closing of the switch as the figure is rocked in forward and rearward directions. One motion switch embodiment includes a rolling ball and is oriented in the hollow figure such that the rolling ball has a travel direction within the switch generally parallel to a front-to-rear longitudinal axis of the hollow figure. The rolling ball switch is equipped with multiple circuit-closing contacts and is configured to simultaneously illuminate all hooves or one pair of hooves separately from the other pair. Another motion switch includes a conductive post and surrounding coil spring.

12 Claims, 3 Drawing Sheets

EQUINE-SHAPED TOY FIGURE

FIELD OF THE INVENTION

The invention relates to children's toys and, in particular, to a hand-holdable equine-shaped toy figure that is electrically illuminated.

BACKGROUND OF THE INVENTION

Children's toys provide greater interest in playtime activities when the toy exhibits stimulatory feedback responses. Toy dolls that talk or cry, that close their eyes in a reclined position and that wet their diapers are well known. These life-like functions in the toy figure give the child more playtime enjoyment.

Animal figures are also popular children's toys, especially teddy bears and other cuddly figures. Horse figures are also popular with children, but these children's toys typically lack the life-like functions often found in toy doll figures.

Among the more popular prior art toys with stimulatory feedback are doll or cuddly animal figures with battery-powered illumination of the figure's body, face or eyes, to provide bedtime comfort to children. Examples of these toys are those described in U.S. Pat. No. 3,808,418 of Conard et al. (animal, e.g., bear, with flashing eyes); U.S. Pat. No. 4,464,861 of Fogerty et al. (glowworm plush toy); U.S. Pat. No. 4,734,074 of Kinberg et al. (owl with flashing eyes and hooting sound); U.S. Pat. No. 4,752,273 of Woods (doll with lightable eyes); U.S. Pat. No. 5,052,969 of Smith (doll with flashing tiara; U.S. Pat. No. 5,114,376 of Copley et al. (stuffed animal, e.g., bear, with illuminated belly); and U.S. Pat. Nos. 5,328,401 and 4,585,424, both of Demars (blushing toy animals).

Other similar battery-powered toys include illuminated baby rattles, as described in U.S. Pat. No. 2,484,159 of Flynn, Jr., illuminated ridable, rocking toys, as described in U.S. Pat. No. 5,356,329 of Thornell, and a reindeer-shaped music box with a flashing nose, as described in U.S. Pat. No. 4,934,980 of Egolf et al.

The present invention provides an equine-like toy figure with illumination for playtime stimulation.

SUMMARY OF THE INVENTION

In one aspect, the invention is a toy which comprises a hollow figure of equine shape; at least a first hoof of the hollow figure that is transparent or translucent; a light-emitting source mounted inside the figure so as to illuminate the first hoof when the light-emitting source is illuminated; a battery power source within the hollow figure; a wiring circuit within the figure electrically connecting the battery power source and the light-emitting source; and a motion switch interposed in the wiring circuit with the battery power source and the light-emitting source, the motion switch being oriented sufficiently front-to-rear in the hollow figure to effect opening and closing of the switch at least as the figure is rocked in forward and rearward directions.

BRIEF DESCRIPTION OF THE DRAWINGS

The foregoing summary, as well as the following detailed description of a preferred embodiment, is better understood when read in conjunction with the appended diagrammatic drawings. For the purpose of illustrating the invention, there is shown in the drawings an embodiment which is presently preferred. It should be understood, however, that the invention is not limited to the specific instrumentalities, arrangements or methods disclosed. In the drawings which are diagrammatic.

DESCRIPTION OF THE PREFERRED EMBODIMENT

Figure 1:
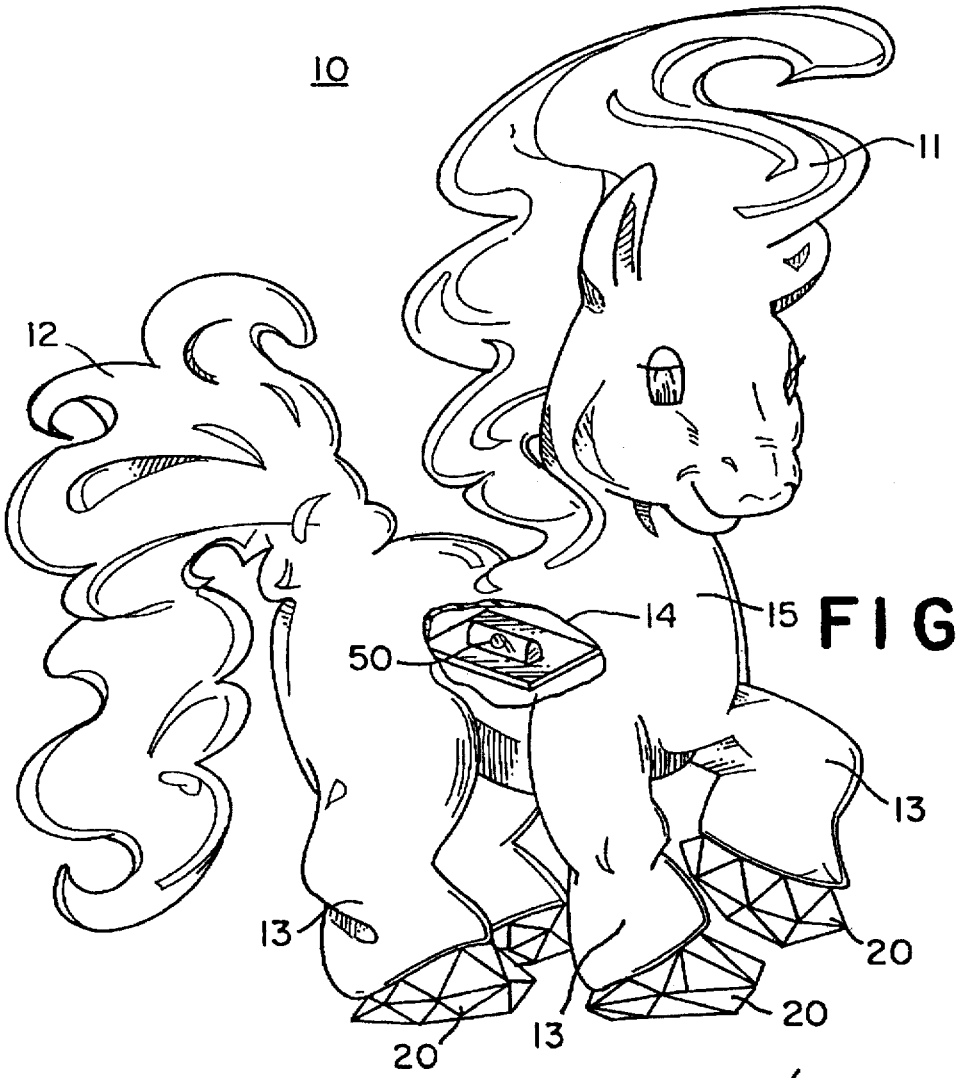
FIG. 1 is a side elevational view of one embodiment of the equine-shaped toy figure of this invention, with the body cavity with a cut-away area to show the rolling ball switch inside.

Certain terminology is used in the following description for convention only and is not limiting. The words "right," "left," "upper," "lower," "top," "bottom," "front" and "rear" designate directions in the drawings to which reference is made.

Referring now to the drawings in which like numerals are used to designate like elements throughout, there is shown in FIG. 1 a child's toy in a preferred embodiment of this invention, indicated generally as 10, in which has the appearance of a pony. The toy could be designed with other equine or equine-like appearances (not shown), e.g., horse, zebra, donkey, etc., or other equivalent four-legged animal.

The toy shown generally as 10 in FIG. 1 is a stylized version of a pony including a hollow figure 15 having an equine shape and conveying the impression of the animal in motion, as evidenced by the flying mane 11 and tail 12 and the position of the legs 13, the left front leg being shown raised.

Figure 3:
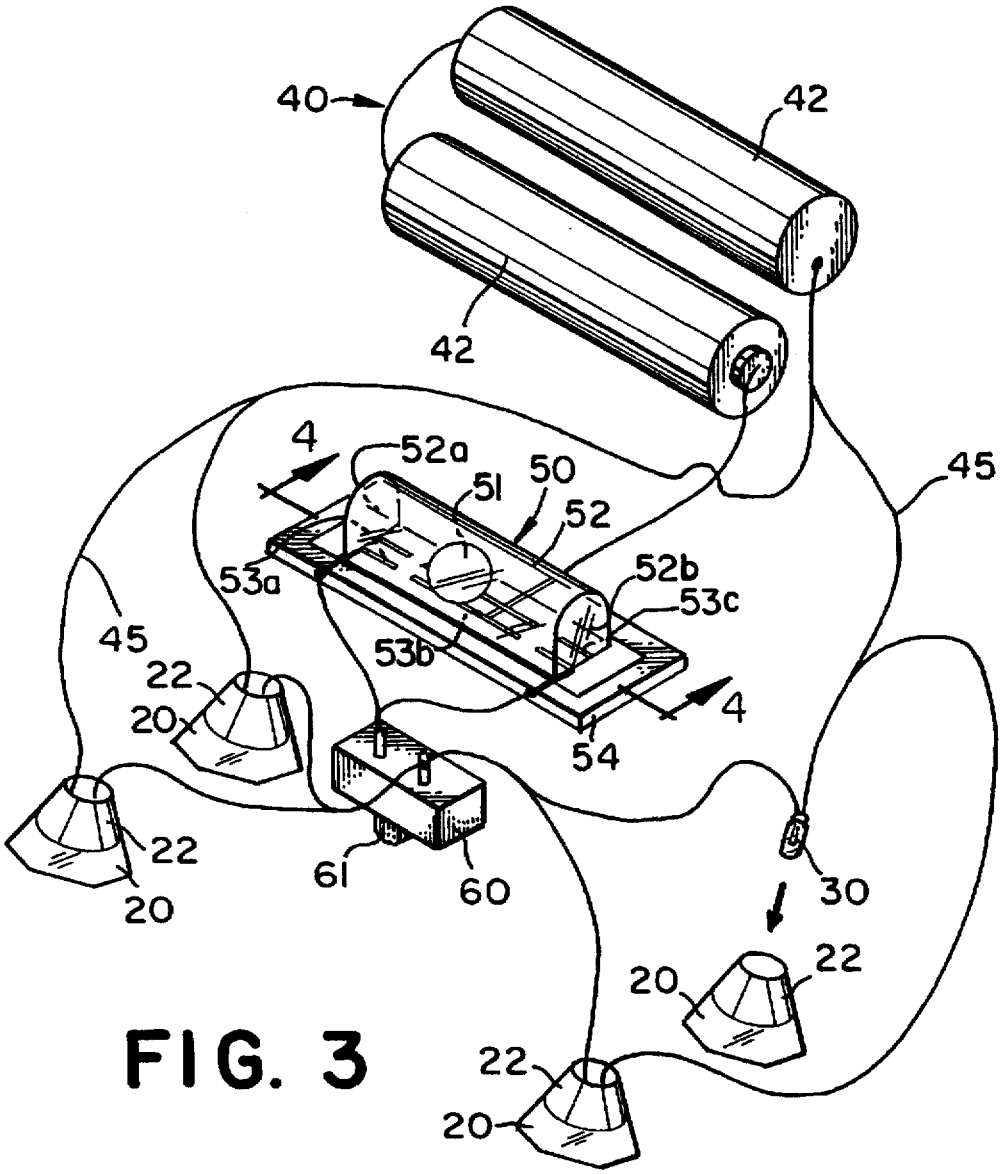
FIG. 3 is a schematic perspective view of the electrical components associated with the illuminated hooves of the equine-shaped toy figure.

Other major parts of components of the toy 10 are shown in FIGS. 1 and 3. These include the transparent or translucent hooves 20; light-emitting sources 30 for illuminating the hooves 20; a battery power source 40; a wiring circuit 45; and a motion switch 50.

Referring to FIG. 1, the toy 10 is desirably constructed of plastic, but other conventional materials, e.g., metal, could also be used. The toy 10 is hollow, as shown by the cut away area 14 in the hollow figure 15 in FIG. 1, to accommodate internally the components (shown in FIG. 3) associated with providing hoof illumination.

The hollow equine figure 10 may be constructed of two mating shells (not shown) that are fused or glued together after the hoof illumination elements, described in more detail below, are incorporated inside.

The toy equine figure 10 is desirably sized to be easily hand held by a child, e.g., the toy equine being about 0.3 meter or less in its largest dimension and weighing less than 1 kg.

Figure 2:
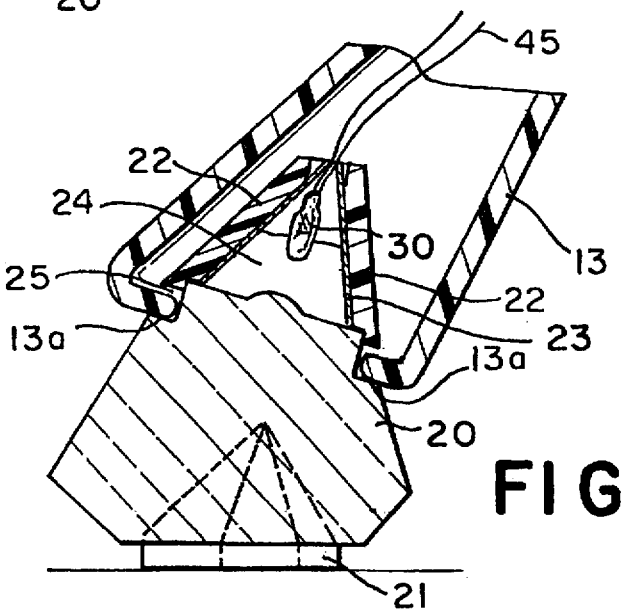
FIG. 2 is a broken-away view of the lower leg and illuminated hoof of the equine-shaped toy figure.

A key characteristic of the toy 10 of this invention is the illuminated hooves 20, one of which is shown in more detail in FIG. 2. According to the invention, at least one of the four hooves 20 is capable of being illuminated and in the preferred embodiment depicted in FIG. 3, all four hooves 20 are capable of being illuminated.

Referring now to FIG. 2, the lower end of one of the hollow figure's leg 13 is shown. Attached to the end of the leg 13 is a hoof 20 that is constructed of a material which transmits light, e.g., clear or colored hard plastic being preferred. The hoof material may either be transparent or translucent. As shown in FIG. 1, the exterior surface of the hoof 20 may be faceted to present an interesting, jewel-like appearance. Further visual interest may optionally be provided, as shown in FIG. 2, by a jewel-like insert 21 in the bottom of the hoof 20. The insert 21, Which replicates a fanciful horseshoe, may be a different color from that of the hoof itself and is desirably light-transmissible like the hoof 20. Preferably, at least the embedded surface portion 21*a* of insert 21 is coated with a metallized material that enhances reflection of the light out of the hoof.

Illumination of the hoof 20 shown in FIG. 2 is provided by means of a suitable light-emitting source. A small light bulb type light-emitting source 30 is shown but other types of light-emitting sources also are suitable, such as light-emitting diodes (LEDs). The wiring circuit 45 (shown in its entirety in FIG. 3), which electrically connects the light-emitting source 30 to the battery power source 40 (shown in FIG. 3 but not in FIG. 2), is also depicted. The wiring of circuit 45 is routed through the hollow leg 13 up in the direction of the body cavity of hollow figure 15.

The light bulb 30 is retained at the narrow end of a bulb holder/reflector 22 that is generally in the shape of a hollow truncated cone. The inner surface of the holder/reflector 22 is preferably coated with a reflective metallic coating 23 that directs light from the energized bulb 30 in the direction of the transparent/translucent hoof 20.

The wide base of the cone-shaped reflector 22 is attached to the upper portion of the hoof 20 inside the leg 13, and this may be accomplished with clear adhesive 24 or other bonding material that optionally fills the interior of the reflector cone 22 or by conventional mechanical interference means such as mating flange(s) and groove(s) or similar snap type structures or by threading or press fit fasteners (none of which are depicted).

The entire hoof assembly, which includes the hoof 20, the bulb holder/reflector 22 and bulb 30 is secured to the leg 13. As shown in FIG. 2, a lip or flange 13*a* around the bottom of the leg is snap-fitted into a corresponding recess 25 in the hoof assembly to provide a secure attachment of the hoof assembly (including elements 20, 22, 30) to the leg 13. Any of the alternative forms of connection listed above can be used to attach the hoof assembly to the figure's leg.

Turning now to FIG. 3, the components associated with illumination of all four hooves 20 in a preferred embodiment, are shown. These components include a battery power source indicated at 40; a light-emitting source bulb 30 (one of four being shown); a wiring circuit 45 for electrically connecting the power source 40 to the one depicted light-emitting source bulb 30 and to the three other light-emitting source bulbs or equivalents associated with each other hoof 20; and a motion switch 50 interposed in the wiring circuit 45 with the light-emitting source bulb 30 and each other light-emitting source and the battery power source 40 for intermittently completing and energizing the wiring circuit. FIG. 3 also shows two major elements (20, 22) of the hoof assemblies that are depicted in greater detail in FIG. 2, and described above. An optional but preferred element shown in FIG. 3 is a manual on/off switch 60, interposed in the wiring circuit 45 and useful as a master switch for ensuring that the electrical circuit remains deenergized when the toy is not in use by a child. The switch 60 is typically a conventional slide switch, with the switch slide button 61 being exposed on the exterior of the figure, e.g., on the figure's belly, for ease of use.

Still referring to FIG. 3, the battery power source 40 is provided by one and more typically by a plurality of conventional dry cells 42 (a pair being shown) coupled together so as to be capable of energizing the light-emitting sources 30. Low voltage dry cells 42, i.e., 9 volts or less, are preferred, conventional 1.5 volt cells being depicted. The battery power source 40 is preferably located in an internal compartment (not shown) in the hollow figure 15 of the toy 10, that permits access to and replacement of depleted batteries 42.

Figure 4:
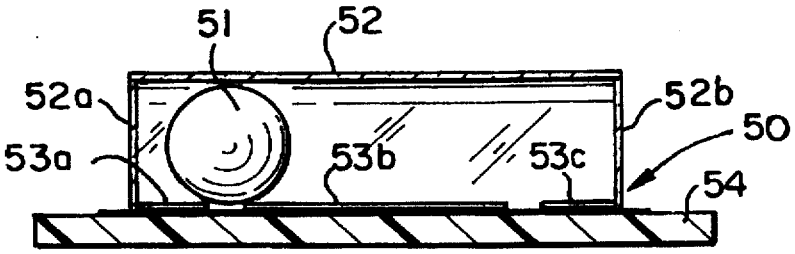
FIG. 4 is a cross-sectional side view (along the line 4—4 in FIG. 3) of a preferred embodiment of the rolling ball switch shown in FIG. 3.

The motion switch 50 is an important element in the present invention and for this reason is shown in detail in a preferred embodiment in FIGS. 3 and 4.

The motion switch 50 is designed to provide intermittent closing or energization of the hoof illumination circuit, such that the hoof illumination is characterized as intermittent or flashing during a child's hand-held playing with the toy 10.

Key elements of the motion switch 50 include an electrically conductive ball 51, a cage 52 mounted to a plate 54 and shaped to confine the ball's travel under the influence of gravity and electrical contacts 53*a*, 53*b*, 53*c*, that are circuit-closing contacts located within the ball-confining cage 52 on the plate 54 and defining a path upon which the rolling ball 51 travels. Particulars of these elements are now described in more detail.

The electrically conductive rolling ball 51 is desirably made of metal, such as steel, but electrically conductive polymers, composites and other electrically conductive materials may also be used. The ball 52 may be hollow or solid, and it should have sufficient mass to overcome resting friction and readily begin rolling under the influence of gravity. The electrically conductive ball 52 could even be a bead of mercury.

The motion switch 50 is oriented within the interior of the hollow figure 10 such that the ball 51 has a rolling travel direction that is generally one dimensional and preferably parallel to the front-to-rear longitudinal axis of the hollow figure. The cage 52 containing the ball is designed to direct the ball's travel in essentially a linear direction, the ball 51 being free to roll either forwards or backwards along a linear travel path under the influence of gravity. This ball travel is used to effect opening and closing of the electrical wiring circuit 45 as the figure 10 is manually rocked in a forward and rearward direction, approximating a simulated gait of the equine toy. It will be appreciated that the switch 50 need only be oriented in the hollow toy figure 10 with a travel direction sufficiently front to rear to effect opening and closing of switch 50 when the figure 10 is rocked in forward and rearward directions (e.g. to and fro).

In the motion switch 50, the cage 52 itself, including its end walls defining stops 52*a*, 52*b* at either end of the ball's travel path, preferably is constructed of a nonconductive material such as a rigid plastic. In a preferred embodiment, the ball travel limit stops 52*a*, 52*b* are sound generating and conductive, such that impact of the rolling ball 51 with either travel stop generates an audible click, clop or other equine gait-simulating sound which can be heard outside the hollow figure 15.

As shown in FIGS. 3 and 4, the cage 52 of the motion switch 50 is attached to base plate 54 that has the circuit-closing contacts 53*a*, 53*b*, 53*c* of the switch mounted on it. The base plate 54 also serves as a convenient member for mounting the switch 50 in the interior of the hollow figure 15, as well as providing attachment points for connecting the circuit wiring 45 to the electrical circuit-closing contacts 53*a*, 53*b*, 53*c*.

The electrical contacts 53a, 53b, 53c in the motion switch 50, in conjunction with the electrically conductive ball 51, are the means by which the hoof illuminating wiring circuit 45 is intermittently energized. The electrical contacts 53a, 53b, 53c are located or positioned in or along or, as depicted, actually define at least part of the travel path of the ball 51. Adjoining ends of the contacts 53a, 53b and 53b, 53c are spaced sufficiently close to one another that the rolling ball bridges the pairs contacts 53a, 53b and 53b, 53c for at least a short time to close the circuit 45 during the ball's travel back and forth within the cage 52, enabling the energized circuit 45 to illuminate hooves 20 via the light bulbs 30.

The particular embodiment of motion switch 50 depicted in FIGS. 3 and 4 features two of each of the electrical contacts 53a, 53b, 53c, which effectively define two segmented rails on which the rolling ball 51 travels when the hollow figure 10 is rocked to and fro in an upright position, with the legs 13 generally pointing down. Although two, parallel rails are effectively provided, a single segmented rail could also be used, if desired.

As shown in FIG. 3, the wiring circuit 45 becomes electrically closed when the ball 51 bridges the gaps in the parallel rails between the middle portion 53b of the parallel rails and the right side portion 53c or the left side portion of the parallel rails. The wiring circuit 45 is thus electrically energized (assuming that the master on/off switch 60 is in an "on," circuit-closing position) and the light source bulbs 30 in the four hooves 20 are thereby illuminated.

Figure 5:
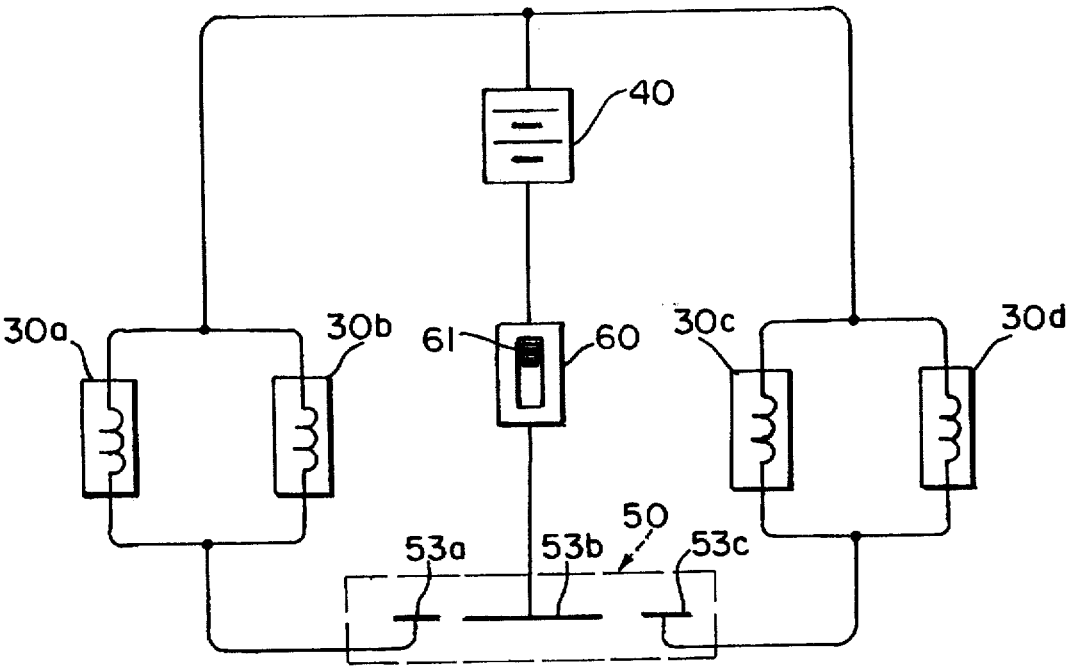
FIG. 5 is a schematic of an alternate arrangement of the electrical components.

In another embodiment shown schematically in FIG. 5, the motion switch 50 of FIG. 3 could be wired in a modified circuit 45' to illuminate each pair of hooves (or two or more different hooves) separately. This may be accomplished by wiring the light sources 30a, 30b of one pair of hooves (e.g. the front hooves) to the left side contact portion 53a of the parallel rails and the light sources 30c, 30d of the other, rear pair of hooves to the right side contact portion 53c of the parallel rails. The middle contact portion 53b of the segmented parallel rails would be connected to the battery power source 40 through on-off switch 60 and enable either side portion (right 53c or left 53a) of the segmented parallel rails to electrically close or energize its respective portion of the wiring circuit 45', depending on the position of the rolling ball 51. A desirable aspect of this embodiment is that the intermittent flashing of the two pairs of hooves would emphasize the to and fro gait of a pony or other forward-moving equine, in response to a child's forward and backward rocking of the hand held figure as an approximation of the figure's gait.

In view of the disclosure herein, it is apparent that other components (not shown), e.g., capacitors for storing a charge, could be introduced into the electrical circuit to provide for more controlled intermittent flashing of the illuminated hooves, once the rolling ball 51 effected closure or energizing of the wiring circuit. Moreover, the cage 52 and rail portions 53a, 53b and 53c can be sized and/or positioned with respect to the stops 52a, 52b such that rolling ball 51 spans one of the adjoining pairs of rail segments 53a, 53b or 53b, 53c when the ball 51 contacts either of stops 52a, 52b such that the hooves illuminated by such contact remain illuminated while the figure 15 is tipped.

Figure 6:
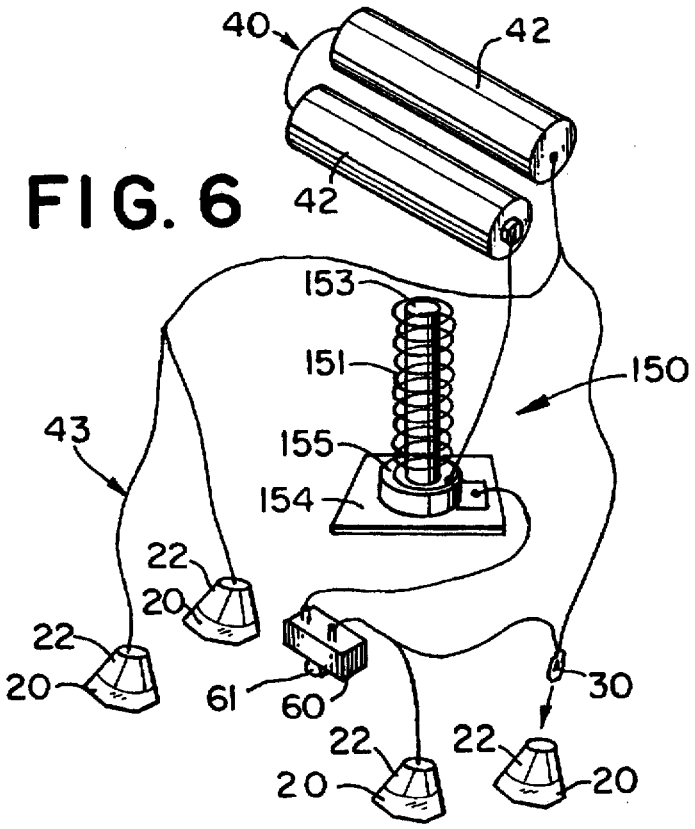
FIG. 6 is a schematic perspective view of an alternate set of electrical components associated with the illuminated hooves of the equine-shaped toy figure.

Also, other types of control arrangements are possible. For example, FIG. 6 depicts the electrical components of FIG. 3 substituting a different type of motion switch indicated generally at 150. Motion switch 150 includes a gravity responsive member in the form of a coil spring 151 and a contact provided by a conductive metal post 153. The post 153 is supported on an insulated base 54. If necessary, the coil spring 151 can be electrically isolated from the post 153 on the base 154 by an electrically insulative ring 155 which may be secured to the base by suitable means such as an adhesive or mechanical engagement. The near end of the spring 153 may be fixedly engaged to the ring 155 such as by an adhesive or by threading or fitting within a groove or over a lip or other mechanical arrangement, as desired. The spring 151 is cantilevered from ring 155 (or base 154). The spring 151 is preferably sufficiently flexible so that when the toy 10 is pitched forwardly or rearwardly to a sufficient degree, for example, to simulate galloping, the remote or free or distal end of the spring 151 will contact the metal post 53 completing and activating the wiring circuit 45 to illuminate the various hooves 20.

Without further modification, motion switch 150 would be responsive to pitching of the toy 10 from its nominal upright position to a sufficient degree in any direction. If desired, the firmness of the spring 151 could be varied so that the amount or suddenness of the motion required to bring the remote end of the spring 51 into contact with the post 153 is varied. If further viewed as necessary or desirable, motion switch 150 could be made to operate only in response to forward and/or rearward pitch orientations of the hollow figure 15, for example by insulating opposing lateral sides of the conductive metal post 153 so that sides of the post closest to the forward and rearward ends of the hollow figure 15 remain conductive or by providing a flexible insulated sleeving between the spring 151 and the post 153 having gaps closest to the forward and rearward end of the hollow figure 15 through which to contact the post 153. Still alternatively, the switch 150 could be positioned within a housing having an elongated slot oriented front to back in the figure toy 10 to restrict movement of the spring 151 to only forward and rearward directions. Still other alternative arrangements could be made and would occur to those of ordinary skill in this art.

In yet another embodiment (not depicted in the drawings), the eyes of the equine figure could be made of a transparent or translucent material and at least one light-emitting source included inside the figure's head in proximity to the eyes. Such light-emitting source or sources could be electrically connected into the wiring circuit so as to illuminate one or both eyes.

It will be recognized by those skilled in the art that other changes could be made to the above-described embodiments and proposed embodiments of the invention without departing from the broad inventive concepts thereof. It should be understood, therefore, that the invention is not limited to the particular embodiments disclosed or suggested, but is intended to cover any modifications which are within the scope and spirit of the invention, as defined by the appended claims.

I claim:

1. A toy which comprises:

a hollow figure of equine-shape;

at least a first hoof of the hollow figure that is light transmissive;

a light-emitting source mounted inside the figure so as to illuminate the first hoof when the light-emitting source is illuminated;

a battery power source within the hollow figure;

a wiring circuit within the figure electrically connecting the battery power source and the light-emitting source; and a motion switch interposed in the wiring circuit with the battery power source and the light-emitting source, the motion switch being oriented sufficiently front-to-rear in the hollow figure to effect opening and closing of the switch at least as the figure is rocked in forward and rearward directions.

2. The toy of claim 1 wherein the first hoof is a front hoof of the hollow figure and which further comprises another hoof of the hollow figure that is light transmissive and another light-emitting source electrically coupled with the battery power source through the motion switch and located within the hollow figure to illuminate said another hoof when illuminated.

3. The toy of claim 2 in which the motion switch has one set of circuit-closing contacts coupled with the first hoof light-emitting source and the battery power supply and a second set of circuit-closing contacts coupled with the another hoof light-emitting source and the battery supply.

4. The toy of claim 1 in which the motion switch includes a rolling ball having a direction of travel within the motion switch sufficiently front-to-rear in orientation in the hollow figure to effect the opening and closing of the switch as the figure is rocked only in forward and rearward directions.

5. The toy of claim 4 in which the rolling ball is free to move under the influence of gravity and in which the rolling ball switch further comprises:

a cage shaped to confine the ball in the switch to essentially linear travel forward and backward in the hollow figure;

a mounting plate, on which the cage is attached and which is mounted in the interior of the hollow figure; and electrical contacts located within the cage and connected to the electrical wiring circuit, the contacts being located on the path upon which the rolling ball travels within the cage and being spaced sufficiently close such that the rolling ball bridges the contacts to close the circuit during its travel within the cage.

6. The toy of claim 5 wherein the electrical contacts in the rolling ball switch include a segmented, electrically conductive rail located within the cage and upon which the rolling ball travels within the cage, the segments of the rail being electrically connected to the wiring circuit and the segments being spaced sufficiently close such that the rolling ball bridges adjoining rail segments to close the circuit during its travel within the cage.

7. The toy of claim 5 wherein the rolling ball switch includes travel stops that limit ball travel within the switch and the ball in the rolling ball switch is fabricated of an electrically conductive metal that transmits to the exterior of the hollow figure an audible sound as the rolling ball strikes the travel stops.

8. The toy of claim 1 in which the motion switch includes a conductive member and a conductive coil spring positioned around the conductive member.

9. The toy of claim 1 which further comprises a manual on/off switch interposed in the electrical wiring circuit.

10. The toy of claim 1 in which the one hoof comprises a simulated faceted jewel lens positioned to be illuminated by the first hoof light-emitting source.

11. The toy of claim 1 which further comprises:

transparent or translucent eyes; and at least one light-emitting source mounted inside the hollow figure's head so as to illuminate at least one of the eyes and further being electrically connected to the wiring circuit.

12. The toy of claim 1 wherein the hollow figure is sufficiently small to be hand held by a child.

* * * * *